US007110550B2

(12) United States Patent
Motojima et al.

(10) Patent No.: US 7,110,550 B2
(45) Date of Patent: Sep. 19, 2006

(54) SOUND SYSTEM

(75) Inventors: Akira Motojima, Hyogo (JP); Hiroshi Kowaki, Hyogo (JP); Yuji Tomita, Hyogo (JP); Hideki Matsui, Hyogo (JP)

(73) Assignee: Fujitsu Ten Limited, Hyogo (JP)

( * ) Notice: Subject to any disclaimer, the term of this patent is extended or adjusted under 35 U.S.C. 154(b) by 969 days.

(21) Appl. No.: 09/809,160

(22) Filed: Mar. 16, 2001

(65) Prior Publication Data

US 2001/0022841 A1 Sep. 20, 2001

(30) Foreign Application Priority Data

Mar. 17, 2000 (JP) ..... 2000-076610

(51) Int. Cl.
*H04R 5/00* (2006.01)

(52) U.S. Cl. ..... 381/27; 381/104
(58) Field of Classification Search ..... 381/27, 381/22, 104, 302, 307, 86, 107, 109
See application file for complete search history.

(56) References Cited

U.S. PATENT DOCUMENTS

| | | | | |
|---|---|---|---|---|
| 4,024,344 | A * | 5/1977 | Dolby et al. | 381/27 |
| 4,866,776 | A * | 9/1989 | Kasai et al. | 381/86 |
| 5,113,447 | A * | 5/1992 | Hatley et al. | 381/27 |
| 5,610,986 | A * | 3/1997 | Miles | 381/27 |
| 5,970,152 | A * | 10/1999 | Klayman | 381/27 |
| 6,650,755 | B1 * | 11/2003 | Vaudrey et al. | 381/18 |

FOREIGN PATENT DOCUMENTS

JP 10-290500 10/1998

* cited by examiner

*Primary Examiner*—Stella Woo
(74) *Attorney, Agent, or Firm*—Wenderoth, Lind & Ponack, L.L.P.

(57) ABSTRACT

The present invention was developed in order to realize a multi-channel sound system wherein appropriate output (balance and fader) control can be conducted without adversely affecting the program contents, and a sound system, which can reproduce a plurality of channel signals including at least left and right front channels and a center channel for forward-placed speakers, comprises a gain controller to control the gain of either left or right channel signal and a gain controller to control the gain of the center channel signal depending on the gain control of the left or right channel signal.

16 Claims, 9 Drawing Sheets

Fig.3(a)

Fig.3(b)

SOUND SYSTEM

BACKGROUND OF THE INVENTION

1. Field of the Invention

The present invention relates to a sound system and, more particularly, to a sound system which reproduces a plurality of different channel signals, comprising an output (fader and balance) controlling means.

2. Description of the Relevant Art

An output controlling means in a conventional 2-channel sound system is used for correction in the case where the displacement of the normal is caused by the arrangement of speakers, the position of a listener, or the like in reproducing each channel signal using the speakers. The gain on the side toward which the normal is shifted is made smaller thereby, while that on the other side is kept constant. For example, when a control is turned right in left-right balance control, the output level of a channel signal on the right side is constant, while the output level of a channel signal on the opposite left side is attenuated. The sound volume output from the right side speaker is constant, and only the sound volume output from the left side speaker becomes smaller.

However, in a sound reproducing system such as a DVD deck which outputs a plurality of, for example, 6 different channel signals, a so-called multi-channel sound system, separate signals are in each channel, respectively. Therefore, the control cannot be adequately conducted using the above conventional output (fader and balance) controlling means, so that the reduction of a certain channel signal adversely affects the program contents occasionally (e.g. the sounds lack a feeling of being in harmony with the images because some sound to be naturally heard becomes too small). As a result, it is difficult to control the sound volume output from each speaker without bringing a feeling of unnaturalness. Particularly as to an in-car audio system having many limitations on the locations of a display and speakers and the position of a listener, the problem is more pronounced.

SUMMARY OF THE INVENTION

The present invention was accomplished in order to solve the above problem, and it is an object of the present invention to realize a sound system, being even a sound system which reproduces a plurality of different channel signals separately, wherein appropriate output control such as fader and balance control can be performed without adversely affecting the program contents.

In order to achieve the above object, a sound system (1) according to the present invention is characterized by being a sound system which can reproduce a plurality of channel signals including at least left and right front channels and a center channel for forward-placed speakers, comprising an attenuating means to attenuate either left or right channel signal and a controlling means to control the attenuation of the center channel signal depending on the attenuation of the left or right channel signal.

Using the above sound system (1), since the output level of the center channel signal is controlled according to the attenuation of either left or right channel signal, the balance of sounds between the left and right channels and the center channel does not become unnatural. As a result, sounds which feel natural and are easy to hear can be reproduced.

A sound system (2) according to the present invention is characterized by the attenuation by the controlling means to control the attenuation of the center channel signal being in the range of 0.3n to 0.8n %, when the attenuation by the attenuating means to attenuate either of the left and right channel signals is conducted in the n % range of the original signal level in the sound system (1).

Using the above sound system (2), the attenuation of the center channel signal is automatically controlled in a proper range to the attenuation of either of the left and right channel signals, so that even after controlling the output level of the left or right channel, sounds which feel natural and are easy to hear can be reproduced.

A sound system (3) according to the present invention is characterized by being a sound system which can reproduce a plurality of channel signals including at least left and right front channels and a center channel for forward-placed speakers, comprising an attenuating means to attenuate either left or right channel signal, an adding means to add the attenuated left or right channel signal to the center channel, and an adding means to add the center channel signal to the right or left channel not being attenuated.

Using the above sound system (3), it is possible to prevent the occurrence of a problem that no sounds of a certain channel signal can be heard or the like through the output (balance) control whereby the attenuated channel signal is added to another channel so that the occurrence of the state of unnatural reproduction can be checked.

A sound system (4) according to the present invention is characterized by comprising, when the attenuation by the attenuating means to attenuate either of the left and right channel signals is conducted in the $n_1$% range of the original signal level, the adding means to add so that the amount of the attenuated left or right channel signal to be added to the center channel is in the range of $0.2n_1$ to $0.8n_1$%, and the adding means to add the center channel signal to the right or left channel not being attenuated so that the added amount thereby is in the range of $0.1n_1$ to $0.6n_1$% of the original signal level of the center channel in the sound system (3).

Using the above sound system (4), the added amount to another channel signal is automatically controlled in the above range, so that even after controlling the output level of the left or right channel, sounds which feel natural and are easy to hear can be reproduced.

A sound system (5) according to the present invention is characterized by being a sound system which can reproduce a plurality of channel signals including at least left and right front channels for forward-placed speakers and left and right rear channels for rear-placed speakers, comprising an attenuating means to attenuate either front side or rear side channel signals and an adding means to add the signals on the attenuated channel side to the channel side not being attenuated.

Using the above sound system (5), it is possible to prevent the occurrence of a problem that no sounds of a certain channel signal can be heard or the like through the output (fader) control whereby the attenuated channel signal is added to another channel, so that the occurrence of the state of unnatural reproduction can be checked.

A sound system (6) according to the present invention is characterized by comprising the adding means to add the signals on the attenuated channel side to the channel side not being attenuated so that the added amount thereby is in the range of $0.2n_2$ to $0.8n_2$%, when the attenuation by the attenuating means to attenuate either of the front side and rear side channel signals is conducted in the $n_2$% range of the original front side or rear side channel signals in the sound system (5).

Using the above sound system (6), the added amount to another channel signal is automatically controlled in the above range, so that even after controlling the output levels of the front side or rear side channels, sounds which feel natural and are easy to hear can be reproduced.

A sound system (7) according to the present invention is characterized by being a sound system which can reproduce a plurality of channel signals including at least left and right front channels for forward-placed speakers and left and right rear channels for rear-placed speakers, comprising an attenuating means to attenuate either left side or right side channel signals and an adding means to add the signals on the attenuated channel side to the channel side not being attenuated.

Using the above sound system (7), it is possible to prevent the occurrence of a problem that no sounds of a certain channel signal can be heard or the like through the output (balance) control whereby the attenuated channel, signal is added to another channel so that the occurrence of the state of unnatural reproduction can be checked.

A sound system (8) according to the present invention is characterized by comprising the adding means to add the signals on the attenuated channel side to the channel side not being attenuated so that the added amount thereby is in the range of $0.2n_3$ to $0.8n_3$%, when the attenuation by the attenuating means to attenuate either of the left side and right side channel signals is conducted in the $n_3$% range of the original left side or right side channel signals in the sound system (7).

Using the above sound system (8), the added amount to another channel signal is automatically controlled in the above range, so that even after controlling the output levels of the left side or right side channels, sounds which feel natural and are easy to hear can be reproduced.

A sound system (9) according to the present invention is characterized by a delaying means being intervened before the adding means in any of the sound systems (3)–(8).

Using the above sound system (9), since a delaying means is intervened before the adding means, a natural feeling of sound shifting can be obtained, leading to preferable sound reproduction bringing a sense of realism.

A sound system (10) according to the present invention is characterized by comprising an attenuating means to reduce the level of the channel signal on which the addition is conducted so that the level of the channel signal after the addition does not change in any of the sound systems (3)–(9).

Using the above sound system (10), since the signal level is controlled by the attenuating means to reduce the signal level so that the level of the channel signal after the addition does not become higher, the difference in sound volume between each of the channels does not become undesirably large. As a result, the occurrence of the state of unnatural reproduction caused by the extreme difference in the channel signal levels between each of the channels can be prevented.

A sound system (11) according to the present invention is characterized by comprising the attenuating means to reduce the level of the channel signal on which the addition is conducted so that the level of the channel signal after the addition does not change and a controlling means to control by reducing again the attenuated channel signal level depending on the attenuation factor by which the attenuating means conducts attenuation in any of the sound systems (3)–(9).

Using the above sound system (11), the level of the signal to have addition is attenuated down to the original signal level so that the channel signal level after the addition does not become higher, and the signal of the previously attenuated channel is controlled again according to the attenuation. As a result, better-balanced output control can be performed without a rise in the signal levels.

BRIEF DESCRIPTION OF THE DRAWINGS

FIGS. 3(*a*) and 3(*b*) are graphs illustrating an example of an output (balance) control pattern;

DETAILED DESCRIPTION OF THE PREFERRED EMBODIMENTS

The preferred embodiments of the sound system according to the present invention are described below by reference to those Figures.

Figure 1:
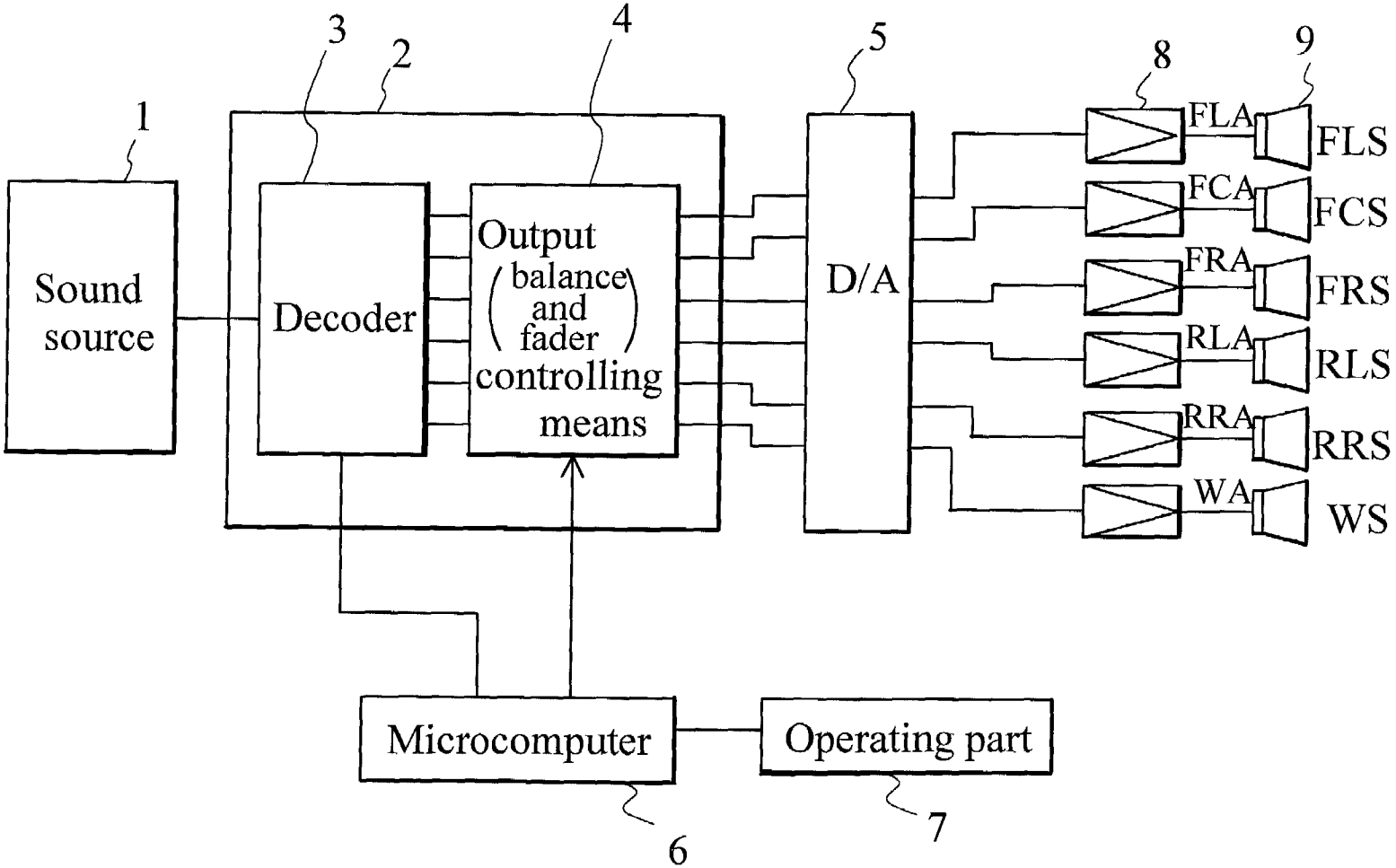
FIG. 1 is a block diagram showing the construction of a sound system according to an embodiment (1) of the present invention.

FIG. 1 is a block diagram showing the construction of a sound system according to an embodiment (1) of the present invention. The sound system according to the embodiment has a sound source 1 such as a DVD, being a multi-track sound source whereby different sounds are output from each speaker arranged in a room, respectively. The sound signals from the sound source 1 are output to a DSP (Digital Signal Processor) 2 which conducts various kinds of digital processing on digital data. The DSP 2 comprises a decoder 3 which decodes digital data from the sound source, and an output balance and fader) controlling means 4 which conducts output control processing on output signals from the decoder 3 based on control signals of output control conditions for each channel from a microcomputer 6 according to how an operating part 7 is operated by a user.

The sound signals constructed dough the DSP 2, on which the balance control or fader control is conducted in the output controlling means 4, being digital signals, are converted to analog signals in a digital-analog converter (D/A) 5. The sound signals output from the D/A 5 are power amplified by each power amplifier FLA (for sounds reproduced at the front and left), FRA (for sounds reproduced at the front and right), FCA (for sounds reproduced at the front and center), RLA (for sounds reproduced at the rear and left), RRA (for sounds reproduced at the rear and right), or WA (for reproducing bass sounds), that amplifies power up to the level where sounds can be reproduced, and are converted to sounds in speakers to reproduce sounds, FLS (forward-left-placed), FRS (forward-right-placed), FCS (forward-center-placed), RLS (rear-left-placed), RRS (rear-right-placed), and WS (woofer), which are arranged on both sides of the front and rear and in the center of the front in a room. Here, the D/A 5 is shown as being of one construction, but actually, there are constructions for 6 channels therein.

The operating part 7, being used for conducting various kinds of operation of the sound system including the setting of output control, comprises a push button switch and the like and is connected to the microcomputer 6. The microcomputer 6, which conducts various kinds of control of the sound system, comprises a central processing unit (CPU) to conduct operation processing, a ROM in which programs, various kinds of constants and the like are stored, a RAM used for brief memory of various kinds of data such as controlled output control characteristic data, data in the course of operation processing, and the like. By outputting control signals of output control conditions for each channel to the output controlling means 4 in the DSP 2 from the microcomputer 6 according to the operation state of the operating part 7, desired output control processing can be conducted.

Figure 2:
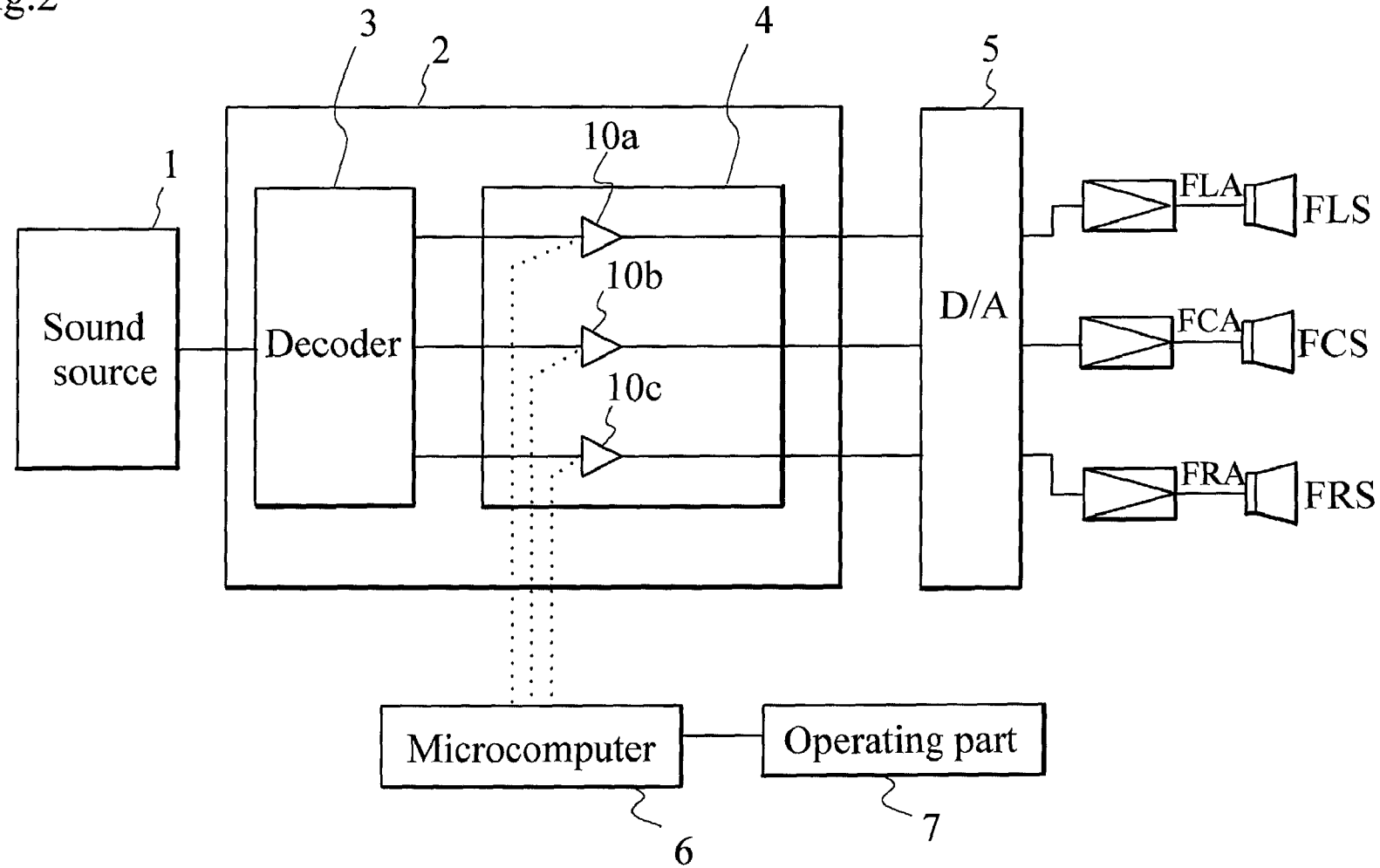
FIG. 2 is a block diagram more specifically showing the construction of a sound system according to the embodiment (1) of the present invention.

FIG. 2 is a block diagram more specifically showing the output controlling means in the sound system according to the embodiment (1) of the present invention.

The DSP 2 has the output controlling means 4 which conducts control of balance and fader of each channel signal. The output controlling means 4 comprises gain controllers 10*a*–10*c* for each of front-left, front-center and front-right channels, respectively, by which gain control of each channel is conducted based on control signals transmitted from the microcomputer 6.

FIG. 3 is a graph illustrating an example of a change in the output signal levels before and after control of each channel signal when balance control is conducted in the sound system according to the embodiment (1). FIGS. 3(*a*) and 3(*b*) show each channel signal level before control and an example of each channel signal level after the balance control, respectively. For example, when the signal level of the front-left channel is controlled in the operating part 7 so as to be attenuated by n %, a control signal is output from the microcomputer 6 to the output controlling means 4 so that the front-center channel signal is output after attenuating in the range of 0.3n to 0.8n % of the original signal level, and gain control is conducted in the gain controllers 10*a* and 10*b*. A programming means (not shown) is arranged so that the control of the gain amount of the front-center channel can be programmed according to the position setting of a listener, distance setting between speakers, or a preference of a user in the operating part 7, and those control patterns can be also stored in the RAM of the microcomputer 6.

Since the sound signal of the center channel is controlled according to the attenuation of the left or right channel through the above control, the sound balance between the left and right channels and the center channel is not unnatural, so that sounds which feel natural can be reproduced.

Figure 4:
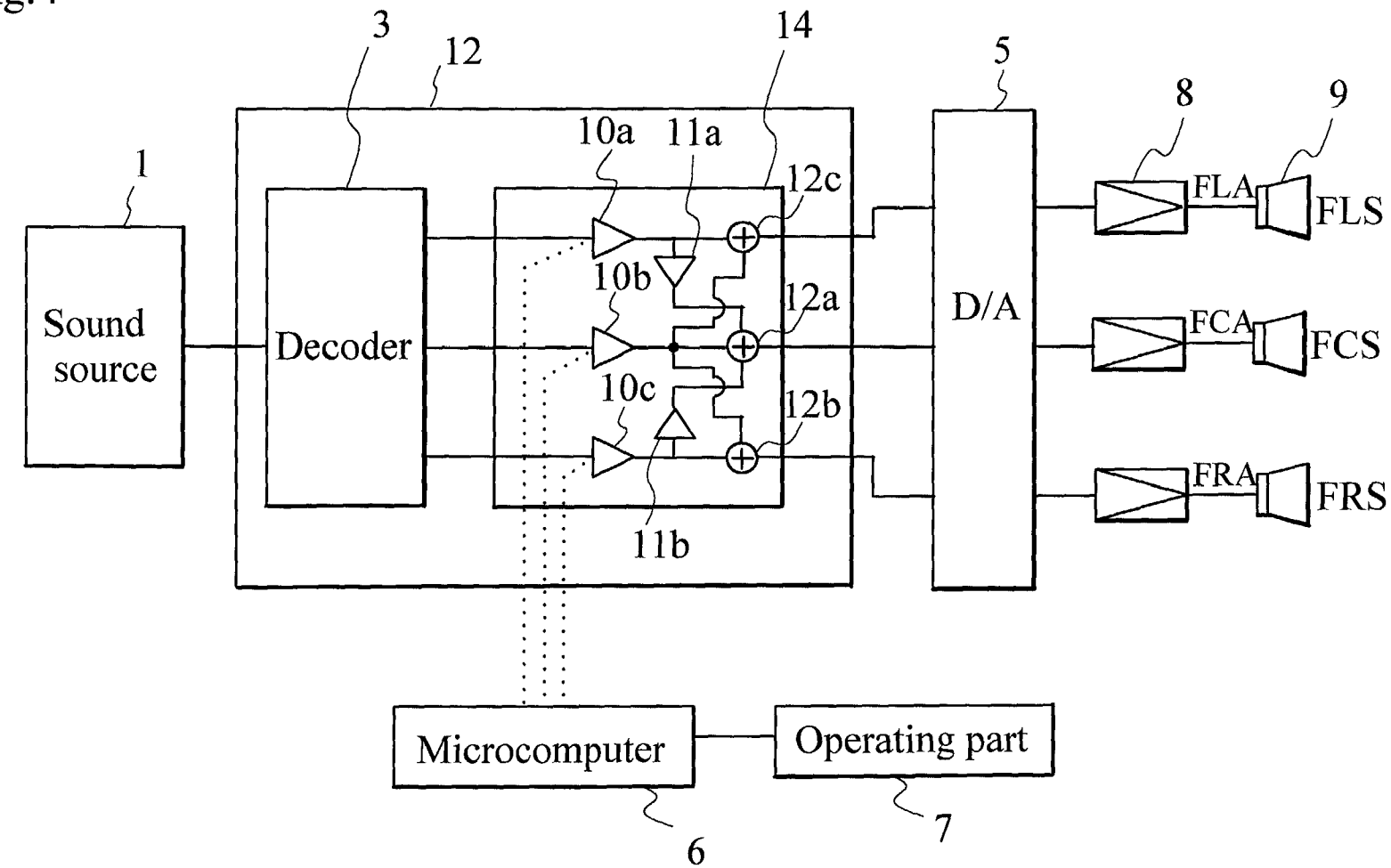
FIG. 4 is a block diagram showing the construction of a sound system according to an embodiment (2) of the present invention.

An embodiment (2) according to the present invention is described here. FIG. 4 is a block diagram showing the outline of the construction of a sound system according to the embodiment (2). Here, the same marks are affixed to the same constituents as those of the sound system according to the embodiment (1), that are not described.

A DSP 12 has an output controlling means 14 which conducts balance control of each channel signal. The output controlling means 14 comprises gain controllers 10*a*–10*c* for each of front-left, front-center and front-right channels, respectively, by which gain control of each channel is conducted based on control signals transmitted from a microcomputer 6.

Gain controllers 11*a* and 11*b* are used for further controlling the gain of a channel signal for adding part of the gain-controlled channel signal to the center channel signal. An adding means 12*a* is used for adding the left or right channel signal gain-controlled in the gain controller 11*a* or 11*b* to the center channel signal. An adding means 12*b* is used for adding part of the center channel signal to the front-right channel. Similarly, an adding means 12*c* is used for adding part of the center channel signal to the front-left channel.

Figure 5A:
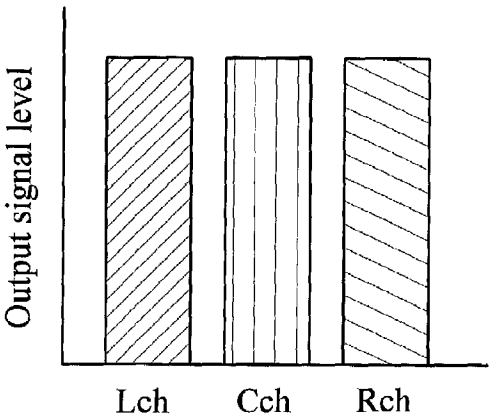
FIGS. 5(*a*)–5(*c*) are graphs illustrating an example of an output (balance) control pattern.
Figure 5B:
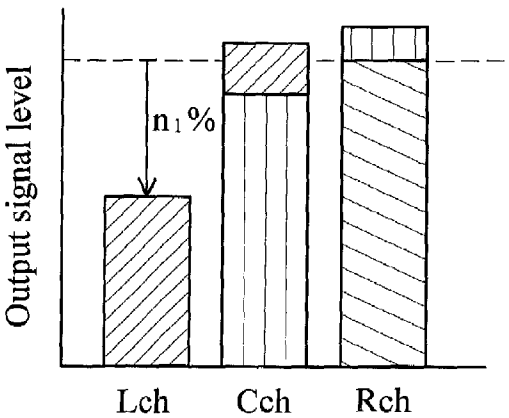
Figure 5C:
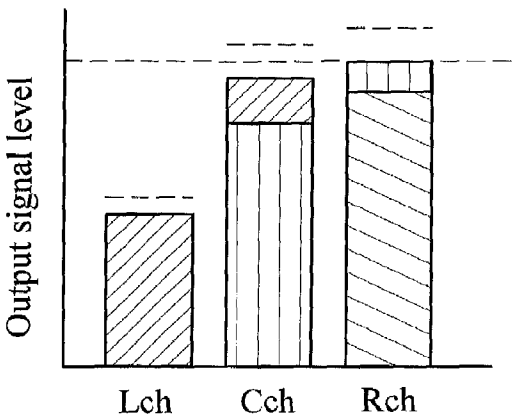

FIG. 5 is a graph illustrating an example of a change in the output signal levels before and after control of each channel signal when balance control is conducted in the sound system according to the embodiment (2). FIGS. 5(*a*) and 5(*b*) show each channel signal level before control and an example of each channel signal level after the balance control, respectively. For example, when the signal level of the front-left channel is controlled so as to be attenuated by $n_1$% using a balance control switch in the operating part 7, a control signal for adding $0.2n_1$ to $0.8n_1$% of the attenuated $n_1$% of the front-left channel signal to the front-center channel signal and a microcomputer control signal for adding the channel signal of $0.1n_1$ to $0.6n_1$% of the original signal level of the front-center channel signal before the balance control to the front-right channel signal are output to the output controlling means 14 in the DSP 12, wherein the processing is conducted.

Using the sound system according to the embodiment (2), even when the level of either left or right channel signal is made lower through the balance control, part of the reduced channel signal is added to the center channel. Therefore, a problem that no sounds from a certain attenuated channel can be heard or the like is not caused, so that appropriate balance control can be conducted even in the multi-channel sound system.

In a sound system according to another embodiment, in order not to cause a feeling of incompatibility with reproduced sounds because of too high a signal level after addition of a channel to have addition, a gain controller may be additionally arranged after the adding means 12*a*, 12*b*, or 12*c* on each channel, respectively. Thereby the signal level of the channel whose signal level is made the highest by addition may be attenuated down to the original signal level before the control, and moreover, the other channel signal levels may be also attenuated by the same attenuation factor as that. By conducting such processing, a sound system which conducts balance control for making sounds better to hear can be realized. The setting of these signal levels is automatically operated in the microcomputer 6 in usual, but it can be also conducted by manual setting in the operating part 7 according to a preference of a user.

The change in the output signal levels in the case wherein the above balance control is conducted is shown in FIG. 5(*c*) in relation to FIGS. 5(*a*) and 5(*b*). The signal level of the front-right channel signal on which addition is conducted in the adding means 12*b* is attenuated down to the original signal level before the control, and by the same attenuation factor as that, the front-left channel signal and the front-center channel signal are attenuated, respectively. By such processing, the overall balance control can be more preferable.

Figure 6:
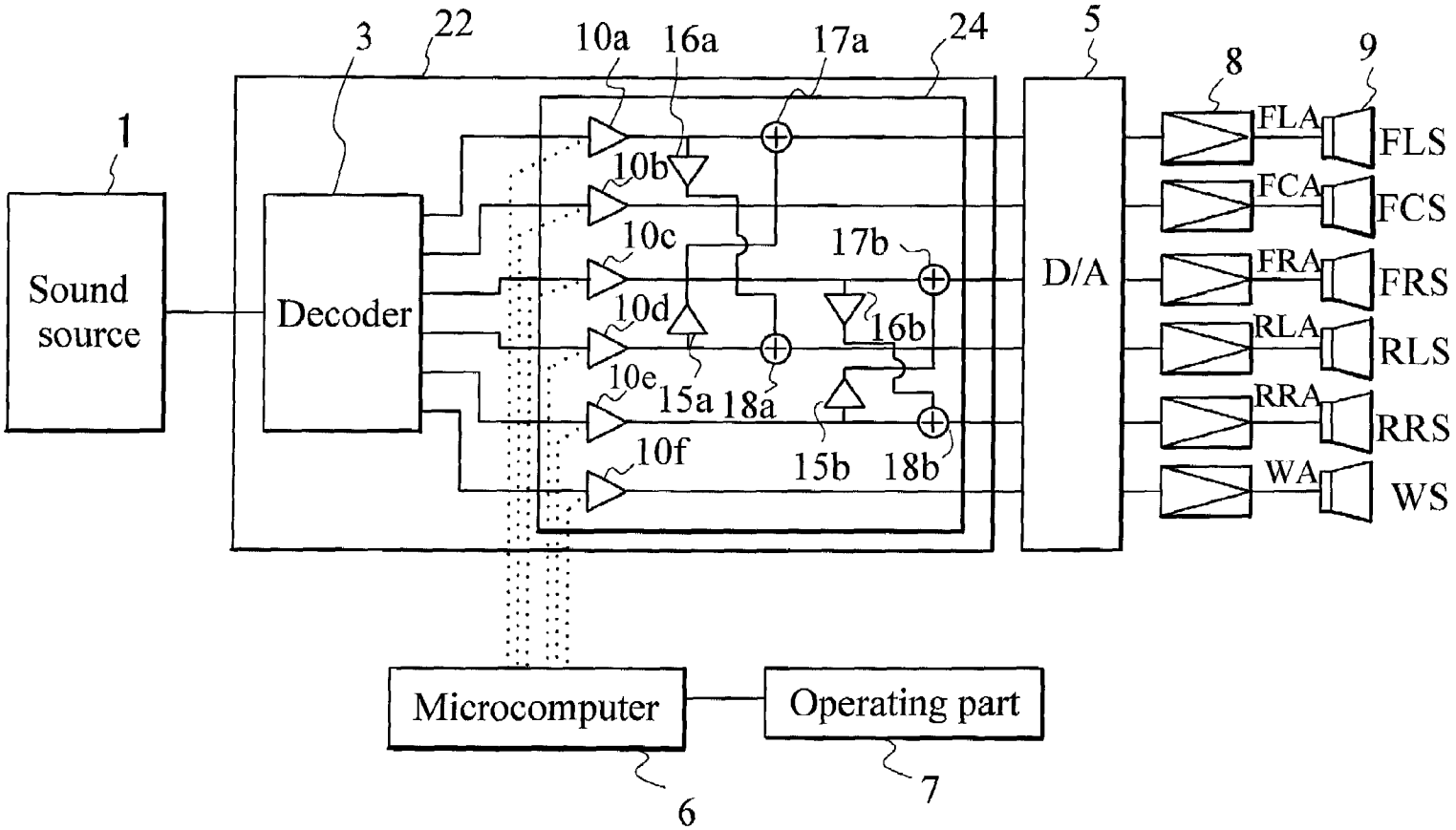
FIG. 6 is a block diagram showing the construction of a sound system according to an embodiment (3) of the present invention.

A sound system according to an embodiment (3) of the present invention is described here. FIG. 6 is a block diagram showing the outline of the construction of a sound system according to the embodiment (3) which reproduces channel signals of 5.1 channels.

A DSP 22 has an output controlling means 24 which conducts balance and fader control of each channel signal. The output controlling means 24 comprises gain controllers

10*a*–10*f* for each channel, by which gain control of each channel is conducted based on control signals transmitted from a microcomputer 6.

Gain controllers 15*a* and 15*b* are used for further controlling the gains in adding part of the left and right rear channel signals gain-controlled through fader control (front-rear balance control) in the gain controllers 10*d* and 10*e* to the left and right front channel signals. Adding means 17*a* and 17*b* are used for adding the left and right rear channel signals gain-controlled in the gain controllers 15*a* and 15*b* to the left and right front channel signals, respectively.

Similarly, gain controllers 16*a* and 16*b* are used for further controlling the gains in adding part of the left and right front channel signals gain-controlled through fader control in the gain controllers 10*a* and 10*c* to the left and right rear channel signals. Adding means 18*a* and 18*b* are used for adding the left and right front channel signals gain-controlled in the gain controllers 16*a* and 16*b* to the left and right rear channel signals, respectively. When the balance is shifted to the front side or rear side through the fader control, the rear side or front side channel signals are attenuated, and part of the attenuated left and right rear channel signals or the attenuated left and right front channel signals are added to the left and right front channels or the left and right rear channels to be output.

Figure 7A:
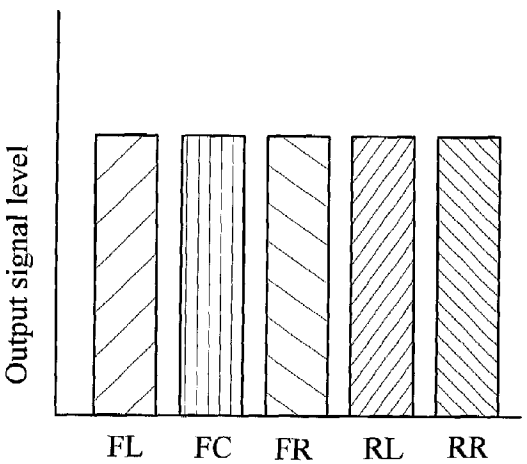
FIGS. 7(*a*)–7(*c*) are graphs illustrating an example of an output (fader) control pattern.
Figure 7B:
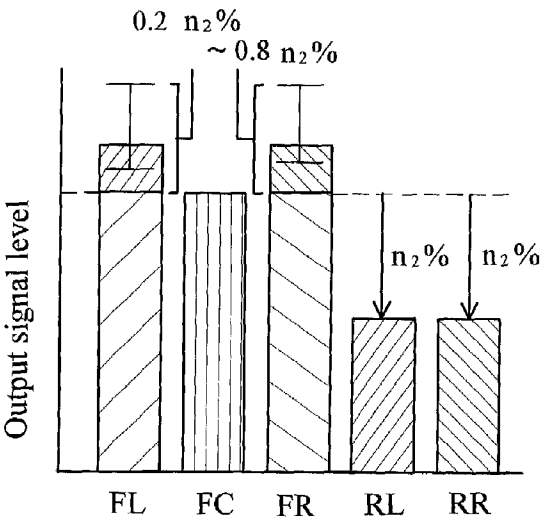
Figure 7C:
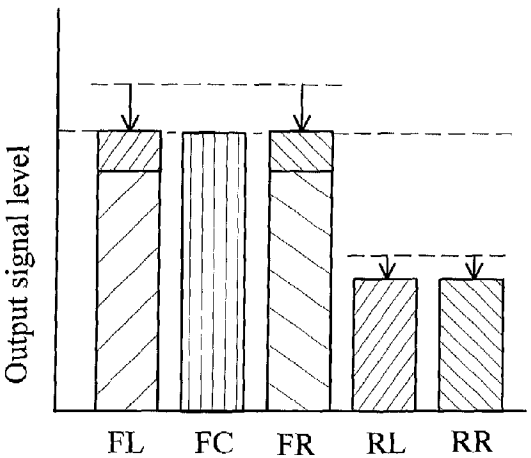

FIG. 7 is a graph illustrating an example of a change in the output signal levels before and after control of each channel signal when fader control is conducted in the sound system according to the embodiment (3). FIGS. 7(*a*) and 7(*b*) show each channel signal level before control and an example of each channel signal level after the fader control, respectively. When the signal levels of the left and right rear channels are controlled so as to be attenuated by $n_2$% using a fader control switch in the operating part 7, a control signal for adding $0.2n_2$ to $0.8n_2$% of the attenuated $n_2$% of the left and right rear channel signals to the left and right front channels is output to the output controlling means 24 in the DSP 22, wherein the processing is conducted.

Using the sound system according to the embodiment (3), even when the levels of either front side or rear side channel signals are made lower through the fader control, part of the attenuated channel signals are added to either rear side or front side channels not being attenuated. Therefore, a problem that no sounds from a certain attenuated channel can be heard or the like is not caused, so that appropriate fader control can be conducted even in the multi-channel sound system.

In a sound system according to another embodiment, in order not to cause a feeling of incompatibility with reproduced sounds because of too high a signal level after addition of a channel to have addition, a gain controller may be additionally arranged after the adding means 17*a*, 17*b*, 18*a*, or 18*b* on each channel, respectively. Thereby the signal level of the channel whose signal level is made the highest by addition may be attenuated down to the original signal level before the control, and moreover, the other channel signal levels may be also attenuated by the same attenuation factor as that. By conducting such processing, a sound system which conducts fader control for making sounds better to hear can be real. The setting of these signal levels is automatically operated in the microcomputer 6 in usual, but it can be also conducted by manual setting in the operating part 7 according to a preference of a user.

The change in the output signal levels in the case wherein the above fader control is conducted is shown in FIG. 7(*c*) in relation to FIGS. 7(*a*) and 7(*b*). The signal levels after addition of the left and right front channel signals on which the addition is conducted in the adding means 17*a* and 17*b* are attenuated down to the original signal levels before the control, and by the same attenuation factor as that, the left and right rear channel signals are attenuated, respectively. By such processing, the overall balance control can be more preferable.

In a sound system according to still another embodiment, a delaying circuit is arranged before each of the adding means 17*a*, 17*b*, 18*a* and 18*b* in FIG. 6. By conducting the delaying processing on each channel signal before addition, a feeling of sound shifting from the front to the rear, and vice versa even in fader controlling can be obtained. As a result, a sound system, by which a preferable sound effect according to a preference of a user can be obtained, can be realized. In addition, the on-off setting of these delaying circuits can be also made based on a control signal transmitted from the microcomputer 6.

Figure 8:
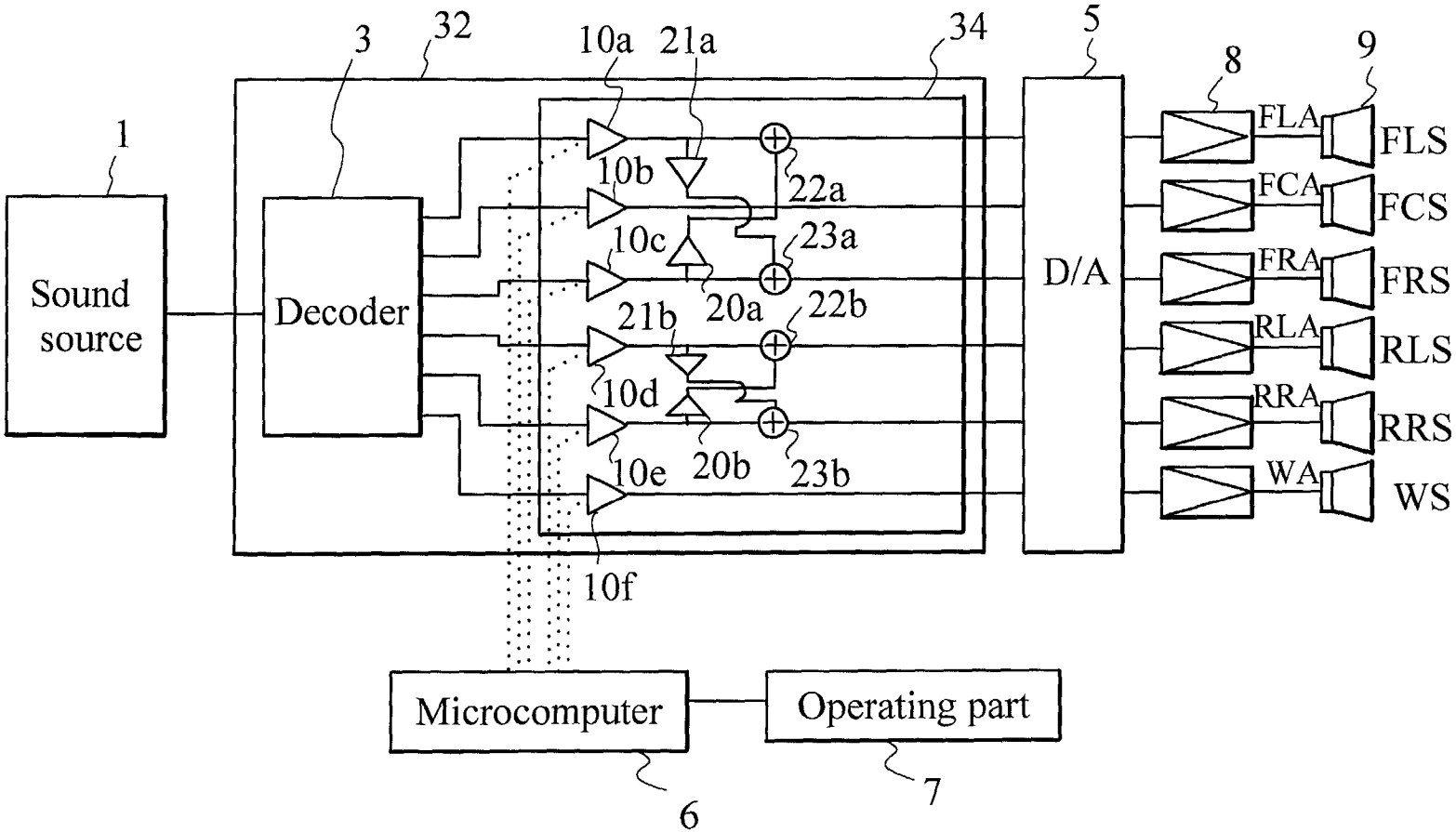
FIG. 8 is a block diagram showing the construction of a sound system according to an embodiment (4) of the present invention.

A sound system according to an embodiment (4) of the present invention is described here. FIG. 8 is a block diagram showing the outline of the construction of a sound system according to the embodiment (4) which reproduces channel signals of 5.1 channels.

A DSP 32 has an output controlling means 34 which conducts balance and fader control of each channel signal. The output controlling means 34 comprises gain controllers 10*a*–10*f* for each channel, by which gain control of each channel is conducted based on control signals transmitted from a microcomputer 6.

Gain controllers 20*a* and 20*b* are used for further controlling the gains in adding part of the front and rear right channel signals on which gain control is conducted through balance control (left-right balance control) in the gain controllers 10*c* and 10*e* to the front and rear left channel signals, respectively. Adding means 22*a* and 22*b* are used for adding the front and rear right channel signals gain-controlled in the gain controllers 20*a* and 20*b* to the front and rear left channel signals, respectively.

Similarly, gain controllers 21*a* and 21*b* are used for further controlling the gains in adding part of the front and rear left channel signals on which gain control is conducted through balance control in the gain controllers 10*a* and 10*d* to the front and rear right channel signals, respectively. Adding means 23*a* and 23*b* are used for adding the front and rear left channel signals gain-controlled in the gain controllers 21*a* and 21*b* to the front and rear right channel signals, respectively. When the balance is shifted to the left side or right side through the balance control, the right side or left side channel signals are attenuated, and part of the attenuated right side channel signals or the attenuated left side channel signals are added to the left side channels or the right side channels to be output.

Figure 9A:
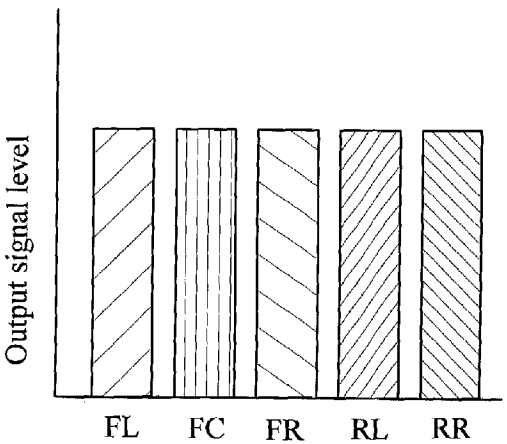
FIGS. 9(*a*)–9(*c*) are graphs illustrating an example of an output (fader and balance) control pattern.
Figure 9B:
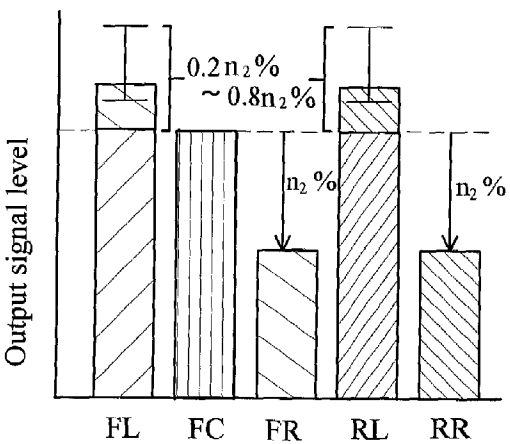
Figure 9C:
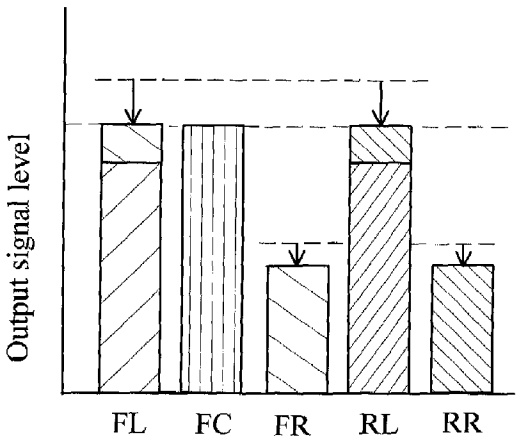

FIG. 9 is a graph illustrating an example of a change in the output signal levels before and after control of each channel signal when balance control is conducted in the sound system according to the embodiment (4). FIGS. 9(*a*) and 9(*b*) show each channel signal level before control and an example of each channel signal level after the balance control, respectively. When the signal levels of the front and rear right channels are controlled so as to be attenuated by $n_2$% using a balance control switch in the operating part 7, a control signal for adding $0.2n_2$ to $0.8n_2$% of the attenuated $n_2$% of the front and rear right channel signals to the front and rear left channels is output to the output controlling means 34 in the DSP 32, wherein the processing is conducted.

Using the sound system according to the embodiment (4), even when the levels of either left side or right side channel signals are made lower through the balance control, part of the attenuated channel signals are added to the right side or left side channels not being attenuated. Therefore, a problem that no sounds from a certain attenuated channel can be heard or the like is not caused, so that appropriate balance control can be conducted even in the multi-channel sound system.

In a sound system according to another embodiment, in order not to cause a feeling of incompatibility with reproduced sounds because of too high a signal level after addition of a channel to have addition, a gain controller may be additionally arranged after the adding means 22*a*, 22*b*, 23*a*, or 23*b* on each channel, respectively. Thereby the signal level of the channel whose signal level is made the highest by addition may be attenuated down to the original signal level before the control, and moreover, the other channel signal levels may be also attenuated by the same attenuation factor as that. By conducting such processing, a sound system which conducts balance control for making sounds better to hear can be realized. The setting of these signal levels is automatically operated in the microcomputer 6 in usual, but it can be also conducted by manual setting in the operating part 7 according to a preference of a user.

The change in the output signal levels in the case wherein the above balance control is conducted is shown in FIG. 9(*c*) in relation to FIGS. 9(*a*) and 9(*b*). The signal levels after addition of the front and rear left channel signals on which the addition is conducted in the adding means 22*a* and 22*b* are attenuated down to the original signal levels before the control and by the same attenuation factor as that, the front and rear right channel signals are attenuated, respectively. By such processing, the overall balance control can be more preferable.

In a sound system according to still another embodiment, a delaying circuit is arranged before each of the adding means 22*a*, 22*b*, 23*a* and 23*b* in FIG. 8. By conducting the delaying processing on each channel signal before the addition, a feeling of sound shifting from the left to the right, and vice versa even in balance controlling can be obtained. As a result, a sound system, by which a preferable sound effect according to a preference of a user can be obtained, can be realized. In addition, the on-off setting of these delaying circuits can be also made based on a control signal transmitted from the microcomputer 6.

What is claimed is:

1. A sound system for reproducing a plurality of channel signals including at least left and right front channels and a center channel for forward-placed speakers, the sound system comprising:

an attenuating means for attenuating either a left channel signal or a right channel signal according to an operation on an operating part; and a controlling means for controlling an attenuation of a center channel signal depending on the attenuation of the left channel signal or the right channel signal.

2. A sound system according to claim 1, wherein the controlling means attenuates the center channel signal in the range of 0.3n to 0.8n %, when the attenuating means attenuates either the left channel signal or the right channel signal in the n % range of an original signal level.

3. A sound system for reproducing a plurality of channel signals including at least left and right front channels and a center channel for forward-placed speakers, the sound system comprising:

an attenuating means for attenuating either a left channel signal or a right channel signal according to an operation on an operating part;

a first adding means for adding at least a portion of the attenuated left or right channel signal to a center channel signal; and a second adding means for adding at least a portion of the center channel signal to the right or left channel signal not being attenuated.

4. A sound system according to claim 3, wherein when the attenuating means attenuates either the left channel signal or the right channel signal in the $n_1$% range of an original signal level:

the first adding means adds an amount of the attenuated left or right channel signal to the center channel signal in the range of $0.2n_1$ to $0.8n_1$%; and the second adding means adds an amount of the center channel signal to the right or left channel signal not being attenuated in the range of $0.1n_1$ to $0.6n_1$% of an original signal level of the center channel signal.

5. A sound system according to claim 4, further comprising delaying means intervened before the first and second adding means.

6. A sound system according to claim 3, further comprising delaying means intervened before the first and second adding means.

7. A sound system according to claim 3, further comprising an additional attenuating means for reducing a level of a highest of the left, center, or right channel signal on which addition is conducted so that the level of the channel signal after the addition does not change.

8. A sound system according to claim 3, further comprising:

an additional attenuating means for reducing a level of a highest of the left, center, or right channel signal on which addition is conducted so that the level of the channel signal after the addition does not change; and a controlling means for controlling by again reducing the attenuated left or right channel signal level depending on an attenuation factor by which the additional attenuating means conducts attenuation.

9. A sound system for reproducing a plurality of channel signals including at least left and right front channels for forward-placed speakers and left and right rear channels for rear-placed speakers, the sound system comprising:

an attenuating means for attenuating either front side channel signals or rear side channel signals according to an operation on an operating part; and an adding means for adding the attenuated side channel signals to the side channel signals not being attenuated.

10. A sound system according to claim 9, wherein when the attenuating means attenuates either the front side channel signals or the rear side channel signals in the $n_2$% range of an original signal level:

the adding means adds an amount of the attenuated side channel signals to the side channel signals not being attenuated in the range of $0.2n_2$ to $0.8n_2$%.

11. A sound system according to claim 10, further comprising a delaying means intervened before the adding means.

12. A sound system according to claim 9, further comprising a delaying means intervened before the adding means.

13. A sound system for reproducing a plurality of channel signals including at least left and right front channels for forward-placed speakers and left and right rear channels for rear-placed speakers, the sound system comprising:

an attenuating means for attenuating either left side channel signals or right side channel signals according to an operation on an operating part; and an adding means for adding at least a portion of the attenuated side channel signals to the side channel signals not being attenuated.

14. A sound system according to claim 13, wherein when the attenuating means attenuates either the left side channel signals or the right side channel signals in the $n_3$% range of original signal levels of the left side channel signals or the right side channel signals:

the adding means adds an amount of the attenuated side channel signals to the side channel signals not being attenuated in the range of $0.2n_3$ to $0.8n_3$%.

15. A sound system according to claim 14, further comprising a delaying means intervened before the adding means.

16. A sound system according to claim 13, further comprising a delaying means intervened before the adding means.

* * * * *